US006793525B2

(12) United States Patent
Wu

(10) Patent No.: US 6,793,525 B2
(45) Date of Patent: Sep. 21, 2004

(54) CONNECTOR BETWEEN LAMP ROD AND LAMP BASE

(76) Inventor: Wen-Chang Wu, No. 10, Lane 191, Hsi Hsin Street, Chuang Ya Tsun, Hsiu Shui Hsiang, Chang Hua Hsien (TW)

( * ) Notice: Subject to any disclaimer, the term of this patent is extended or adjusted under 35 U.S.C. 154(b) by 0 days.

(21) Appl. No.: 10/321,513

(22) Filed: Dec. 18, 2002

(65) Prior Publication Data

US 2004/0142595 A1 Jul. 22, 2004

(51) Int. Cl.[7] ..... H01R 13/60
(52) U.S. Cl. ..... 439/537; 439/529; 362/438
(58) Field of Search ..... 439/529, 537, 439/121, 543, 310, 576; 362/438, 433, 454, 147, 98, 226, 94, 294; 361/727; 313/318

(56) References Cited

U.S. PATENT DOCUMENTS 4,219,870 A * 8/1980 Haraden et al. ..... 362/226
4,222,093 A * 9/1980 Garcia et al. ..... 362/147
5,892,659 A * 4/1999 Cooper et al. ..... 361/727
6,174,077 B1 * 1/2001 Bucher et al. ..... 362/438
6,176,736 B1 * 1/2001 Hsu ..... 439/537
6,322,232 B1 * 11/2001 Oliver ..... 362/147
6,503,099 B2 * 1/2003 Kerr, Jr. ..... 439/537
6,509,678 B2 * 1/2003 Shen ..... 313/318
6,536,926 B2 * 3/2003 Bucher et al. ..... 362/438

* cited by examiner

*Primary Examiner*—Alex Gilman
(74) *Attorney, Agent, or Firm*—Troxell Law Office PLLC

(57) ABSTRACT

The present invention relates to a connector between lamp rod and lamp base, comprising a lamp base coupled to one side of a wire connection box, and a lamp rod inserted into the lamp base; wherein the lamp base is fixed to the wire connection box and a through hole at their corresponsive position by screw bolts, and the lamp base further comprises a passing section for latching the lamp rod, and the upper and lower end of the stairway-like edge of the lamp base respectively have a pair of symmetric locking holes; wherein an insertion base for inserting the connector on the locking hole is disposed at a position proximate to the end of the lamp base; and the bolt passes through a latching bracket and a spring located at upper section of the latching bracket in order and through the locking hole proximate to the front end of the lamp base, such that the lamp rod can be inserted and pressed against the position next to the insertion base of the lamp base, and after the lamp rod is inserted, a blocking dent at the top end of the lamp rod exactly latches and presses against an embedded end of the latching bracket. Such arrangement allows users to simply insert the rod into the lamp base for the assembly of the lamp after they bought it, and facilitates the do-it-yourself (DIY) assembling.

3 Claims, 6 Drawing Sheets

CONNECTOR BETWEEN LAMP ROD AND LAMP BASE

BACKGROUND OF THE INVENTION

1. Field of the Invention

The present invention relates to a connector between lamp rod and lamp base, comprising a pair of symmetric locking holes individually disposed on the upper and lower ends of a stairway-like edge of a lamp base, wherein an insertion section for coupling the lower locking hole is disposed at a position proximate to the rear end of the lamp base, and a bolt passes through a latching bracket and a spring located at the upper section of the latching bracket in sequence, such that after the lamp rod is inserted, the blocking dent at the top of the lamp rod latches and presses against the embedded end of the spring; such arrangement attains the effect of facilitating the do-it-yourself (DIY) assembling of the lamp.

2. Description of the Related Art

Traditional insertion structure of electrically conductive assembly of a lamp, regardless of being used for a wall lamp, table lamp, or floor lamp, generally uses bolts and nuts for connection, however such bolt-and-nut connection method does not only damage the finished goods during assembling, but also requires tools (such as wrench or screwdriver, etc). The electric wire may be easily exposed by the friction produced during the assembly and have the risk of causing electric shocks and cause troubles to the assembling. Therefore, the traditional structure is not suitable for DIY assembling, and manufacturers have to assemble the whole set including the wire connection box and the insert rod of the lamp before selling it, which will increase the cost. In view of these shortcomings, the inventor of the present invention based on years of experience accumulated from the engagement in the related industry conducted extensive research to resolve the aforementioned shortcomings and invented the present invention.

SUMMARY OF THE INVENTION

The primary objective of the present invention is to provide a connector between the lamp rod and the lamp base, comprising of a lamp base coupled to one side of a wire connection box, and a lamp rod inserted into the lamp base; wherein the lamp base is fixed to the wire connection box and a through hole at their corresponsive position by screw bolts, and the lamp base further comprises a passing section for latching the lamp rod, and the upper and lower ends of the stairway-like edge of the lamp base respectively have a pair of symmetric locking holes; wherein an insertion base for inserting the connector into the locking hole is disposed at a position proximate to the end of the lamp base; and the bolt passes in sequence through a latching bracket and a spring located at upper section of the latching bracket and through the locking hole proximate to the front end of the lamp base, such that the lamp rod can be inserted and pressed against the position adjacent to the insertion base of the lamp base, and after the lamp rod is inserted, a blocking dent at the top end of the lamp rod exactly latches and presses against an embedded end of the latching bracket. Such arrangement allows users to insert the rod into the lamp base with a simple and easy way of assembling the lamp after they bought it, and the present invention facilitates the do-it-yourself (DIY) assembling.

To make it easier for our examiner to understand the objective of the invention, its structure, innovative features, and performance, we use a preferred embodiment together with the attached drawings for the detailed description of the invention.

BRIEF DESCRIPTION OF THE DRAWINGS

Other objects, features, and advantages of the invention will become apparent from the following detailed description of the preferred but non-limiting embodiment. The description is made with reference to the accompanying drawings, in which.

DETAILED DESCRIPTION OF THE PREFERRED EMBODIMENTS

Figure 1:
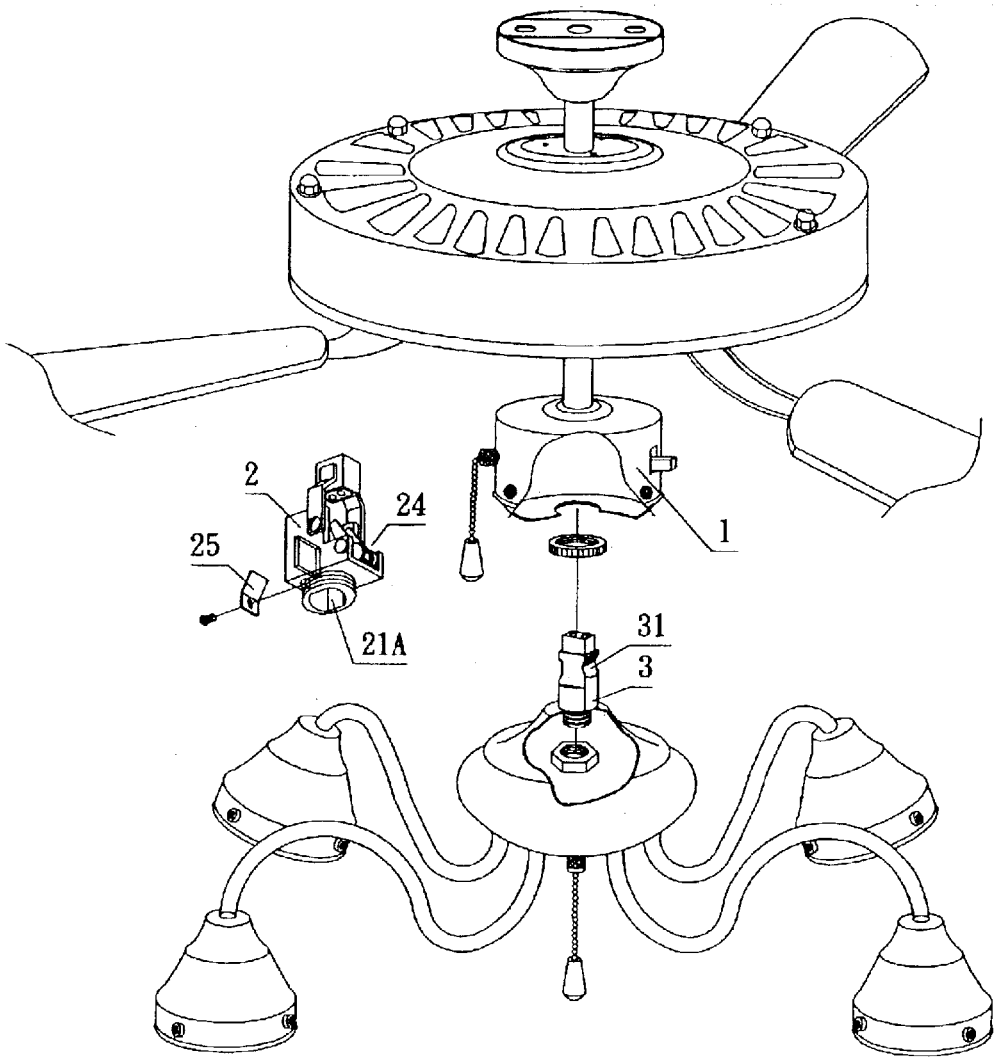
FIG. 1 is a diagram of a ceiling fan/lamp according a preferred embodiment of the present invention.
Figure 2:
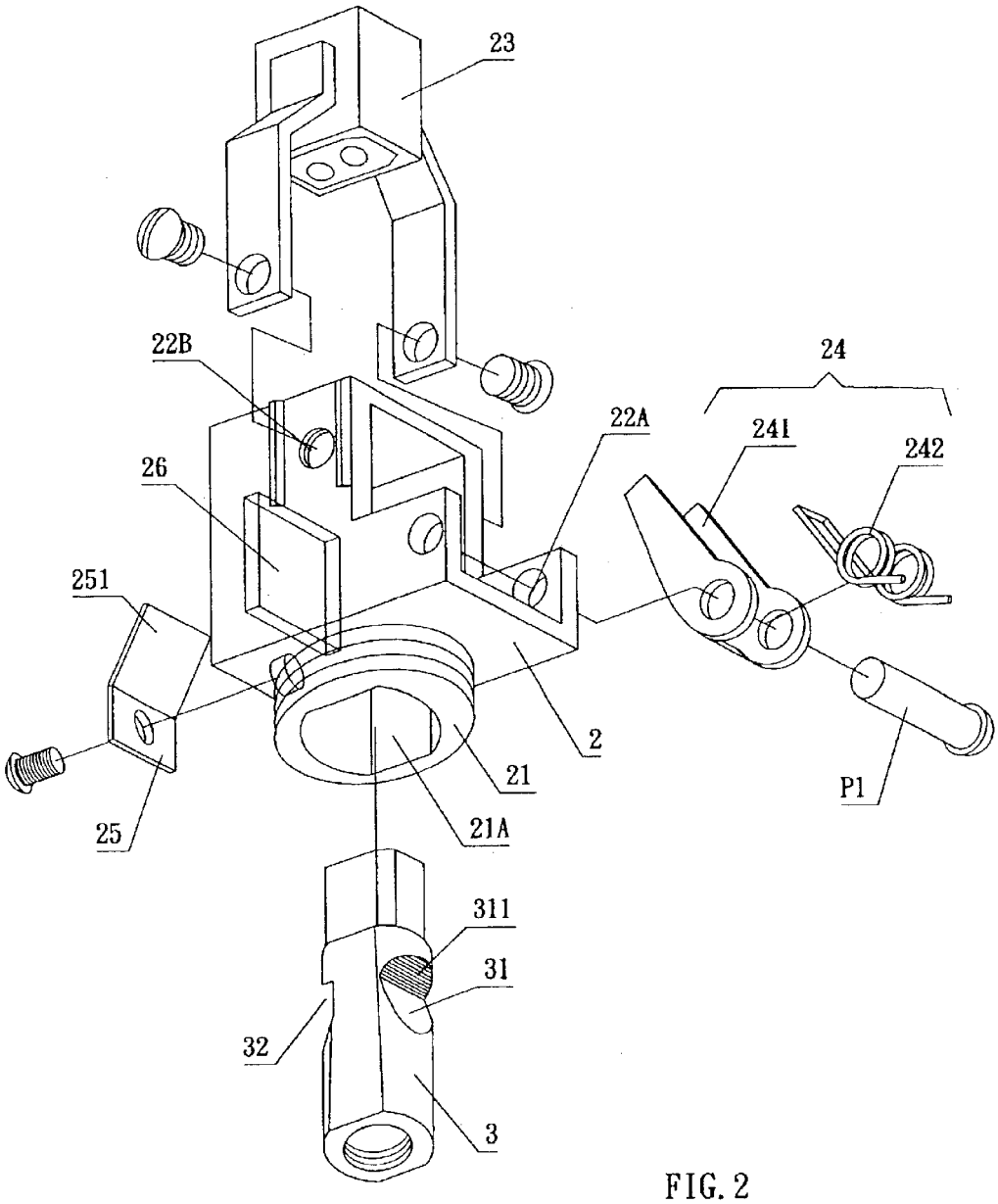
FIG. 2 is an explosive diagram of a ceiling fan/lamp of the present invention.
Figure 3:
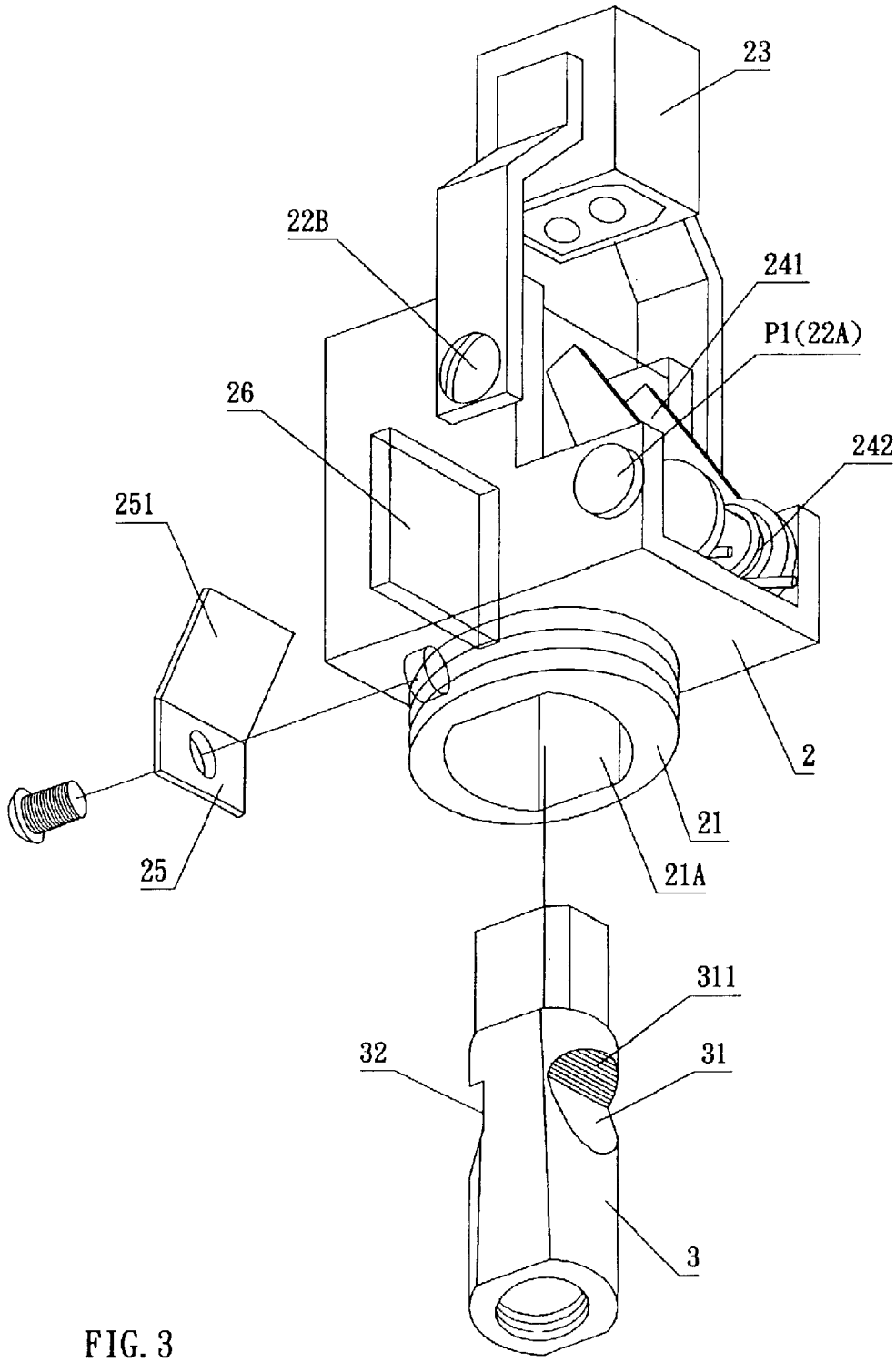
FIG. 3 is an assembled diagram of the present invention.

Please refer to FIGS. 1 to 3 for a clear understanding of the structure and mode of the present invention. The present invention comprises a lamp base 2 disposed on a side of a wire connection box 1, and a lamp rod 3 inserted into the lamp base 2; wherein: a passing hole 11 is disposed at the bottom of the wire connection box 1, and the passing hole 11 and the lamp base 2 are aligned, and a passing section 21 of the lamp base 2 is protruded from the bottom surface of the lamp base 2; a through hole 26 is disposed on the side of the lamp base 2; a spring bracket 25 is fixed to the side of the through hole 26, and the free end 251 of the spring bracket extends slightly into the through hole 26 for latching the lamp rod 3 after it is inserted.

In addition, a pair of symmetric upper and lower locking holes 22A/22B is disposed individually on both sides of the stairway-like edge of the lamp base 2. An insertion base 23 is coupled to the upper locking hole 22B, and the insertion base 23 can exactly receive the connector of the lamp rod 3; the lower locking hole 22A at the bottom of the lamp base 2 is coupled to a restricting structure 24 by a bolt P1; wherein the restricting structure 24 has a bolt P1 passing through the latching bracket 241 with a closed bottom and a spring 242 located at the upper section of the latching bracket in sequence to fix the latching bracket 241 and the spring 242 into the locking hole 22A on the lamp base 2.

The rod of the lamp rod has a conical section and the lamp rod 3 corresponsive to the position of the restricting structure 24 has a cut blocking dent 31 for accommodating the insertion of the passing section 21 of the lamp base such that the head of the lamp rod 3 just presses against the latching bracket 241 of the restricting structure 24 and after the lamp rod 3 is inserted, the restoration of the spring 242 returns the latching bracket 241 to the original position and latches and presses against the cut blocking dent 31 of the lamp rod 3. Further, an indented blocking edge 32 is disposed on the rod corresponsive to the position of the connection of lamp rod 3 and the spring bracket 25 of the lamp base. After the lamp rod 3 is inserted, the free end 251 of the spring bracket 25 exactly latches on the latching edge 32. The cut blocking dent of the lamp rod is latched to an end of the lamp base on a serrate surface 311 to appropriately hook the restricting structure 24 of the lamp base in order to prevent the whole set of ceiling fan/lamp under the lamp rod 3 from falling down due to insufficient support to its weight during assembling. Further, after the lamp rod 3 is inserted into the lamp base 2, the head of the lamp rod exactly inserts into and presses against the insertion base 23 of the lamp base 2 for electric connection.

Figures 4A, 4B, 4C:
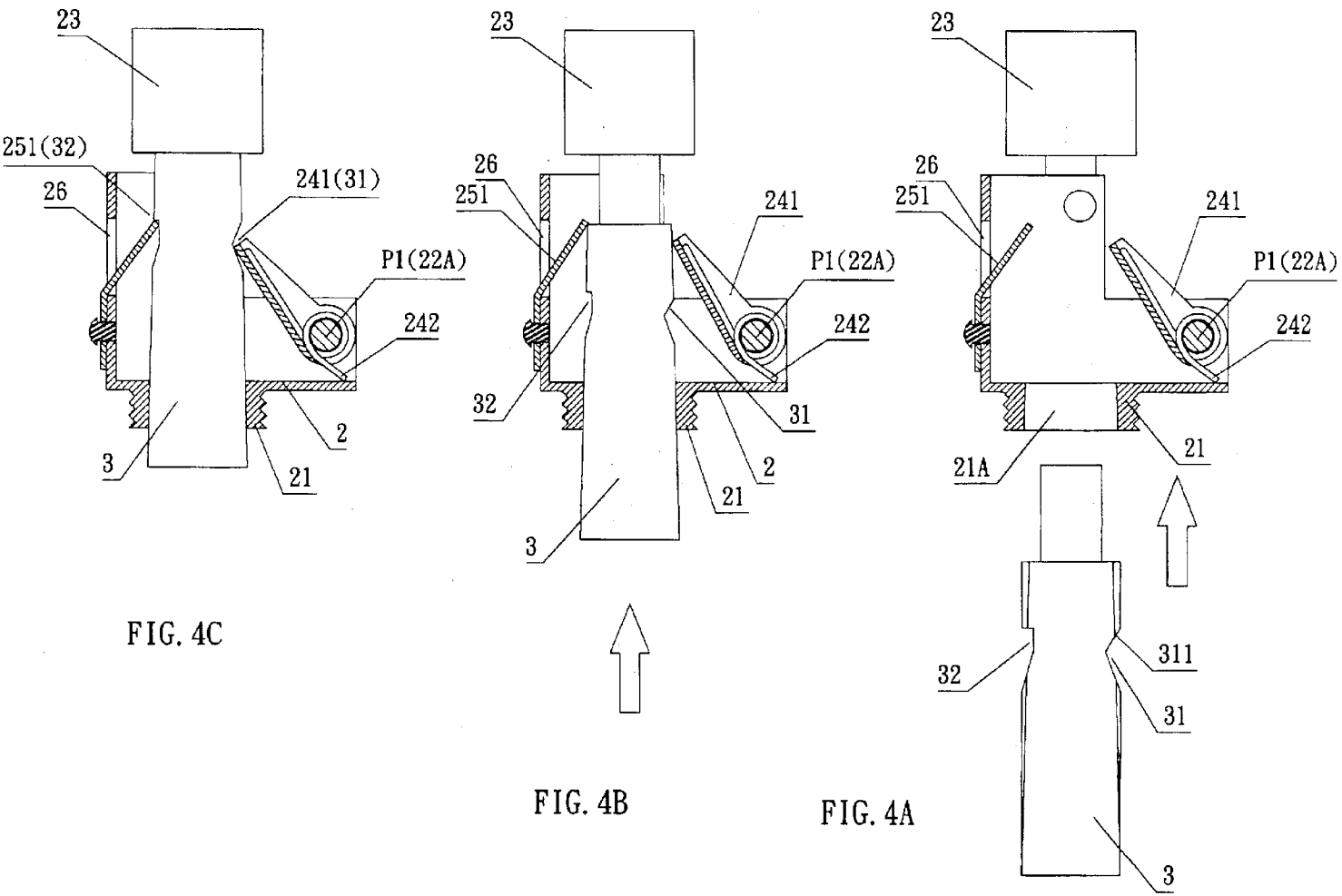
FIG. 4A is a cross-sectional diagram of the lamp rod of the present invention before its insertion.
FIG. 4B is a cross-sectional diagram of the lamp rod of the present invention during its insertion.
FIG. 4C is a cross-sectional diagram of the lamp rod of the present invention after its insertion.

Please refer to FIG. 4. The lamp base 2 uses a bolt P1 to pass through a latching bracket 241 with a closed end and a spring 242 at the upper section of the latching bracket 241 in sequence to fix the latching bracket 241 and the spring 242 into the upper locking hole 22A of the lamp base 2. A cut blocking dent 31 is disposed at the position corresponsive to the restricting structure 24 of the lamp rod 3 and a latching edge is indented on the lamp rod at the position corresponsive to the spring bracket of the lamp base.

By such arrangement, when the lamp rod 3 is inserted through the passing section 21 of the lamp base, the connector of the lamp rod 2 just pushes the latching bracket 241 at the top of the restricting structure outward. At that time, the closed end of the latching bracket 241 will push the spring 242 accordingly such that the spring 242 is twisted and deformed (as shown FIG. 4).

After the lamp rod 3 is completely inserted, the restoration of the spring 242 returns the latching bracket of the restricting structure to the original position. The blocking dent 31 of the lamp rod 3 exactly presses on the latching bracket 241, and the free end 251 of the spring bracket 25 exactly latches the blocking edge 32 of the lamp rod 3, so that the lamp rod 3 is restricted to the lamp base 11. At that time, the head of the lamp rod 3 aligns and presses against the insertion base 23 of the lamp base 2 for the electric connection between the lamp base 2 and the lamp rod 3 (as shown in FIG C).

Figure 5:
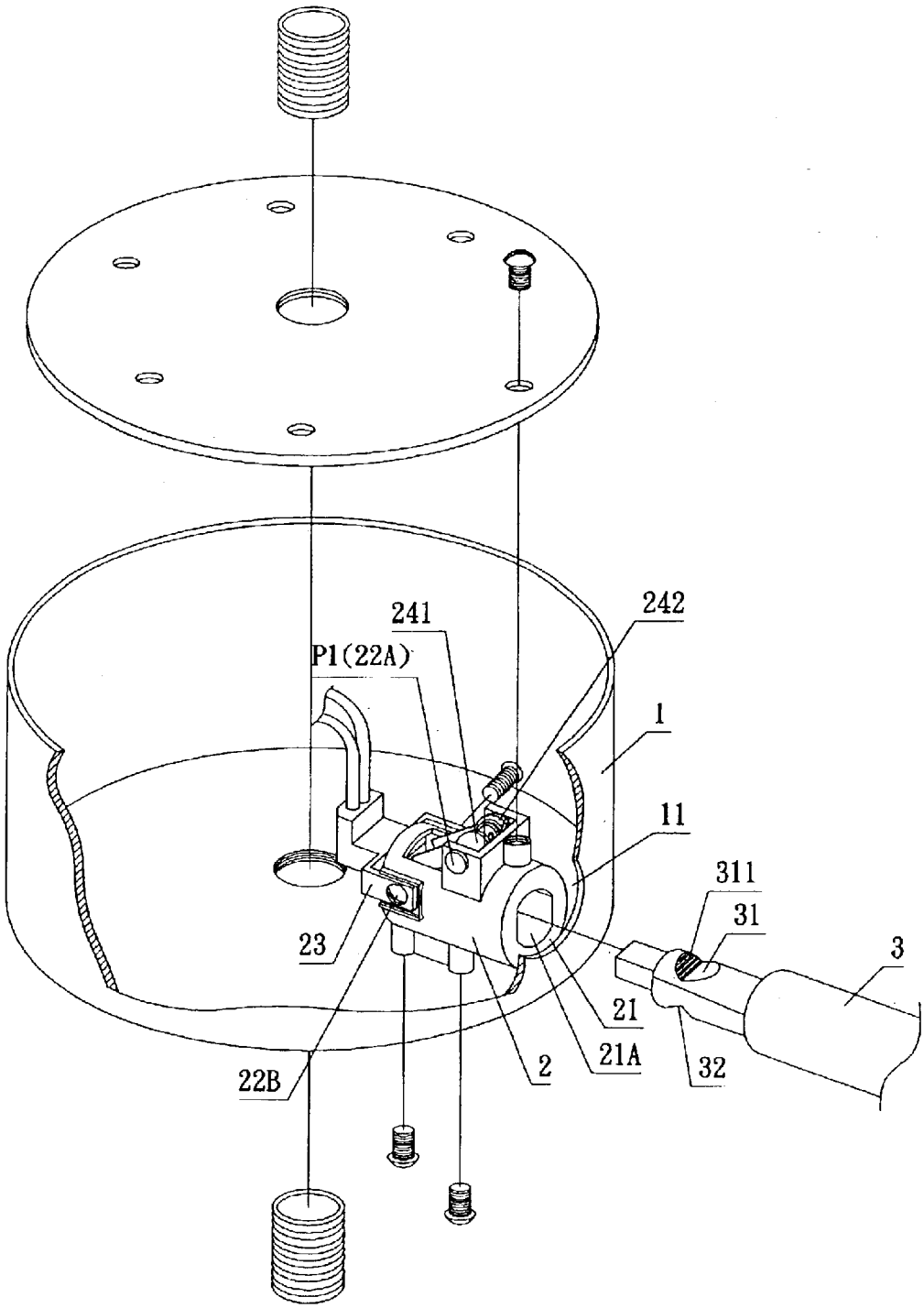
FIG. 5 is an explosive diagram of a ceiling lamp of the present invention.

Please refer to FIG. 5 for the diagram of connector of the present invention used in a ceiling lamp; wherein a through hole 11 is disposed on the side of a wire connection box 1, and a bolt P is disposed on the lamp base 2 at the position corresponsive to the wire connection box and the through hole 11, and a passing hole 21A corresponsive to the through hole of the wire connection box on a side of the lamp base 2 for receiving the insertion of the lamp rod 3.

A pair of upper and lower locking holes 22A/22B is separately disposed at the upper and lower stairway-like edge of the lamp base 2, and an insertion base 23 is coupled onto the lower locking hole 22B, and the insertion base 23 can receive the connector of the lamp rod 3 for the connection. Further, the upper locking hole 22A at the front end of the lamp base 2 is coupled to a restricting structure 24 by a bolt P1, wherein the restricting structure 24 fixes the latching bracket 241 and the spring 242 located at the upper section of the spring 242 onto the upper locking hole 22A of the lamp base 2 by passing in sequence the bolt P1 into the latching bracket 241 with a close bottom and by means of the spring 242 at the upper section of the latching bracket 241.

Figure 6:
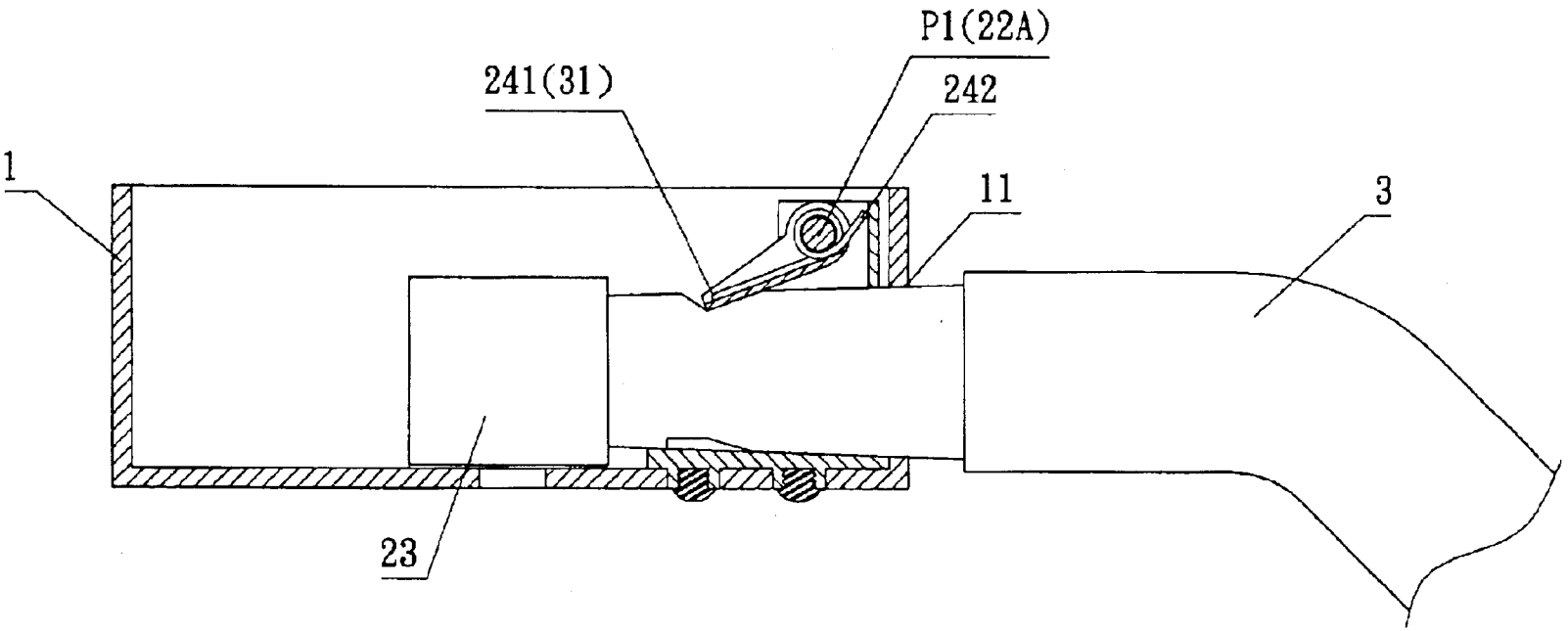
FIG. 6 is a cross-sectional diagram of a ceiling lamp of the present invention.

Please refer to FIG. 6. When the lamp rod 3 is inserted into the passing hole 21A, the connector of the lamp rod 2 just pushes the latching bracket 241 of the restricting structure outward, and then the closed end of the latching bracket 241 will push the spring 242 accordingly such that the spring 242 is twisted and deformed. After the lamp rod 2 is completely inserted, the latching bracket 241 of the restricting structure will return to its original position by the restoration of the spring 242, and restricts the lamp rod 3 on the lamp base 1.

By means of inserting the lamp rod 3 into the lamp base 2, which is installed in a wire connection box 1 in advance, the user just needs to insert the lamp rod 3 into the wire connection box 1 of the lamp base 2 for use, and requires no tools for the bolts and nuts, and attains the effect of facilitating the DIY assembling.

In summation of the above description, the connector between lamp rod and lamp base of the present invention herein enhances the performance over the conventional structure and further complies with the patent application requirements and is submitted to the Patent and Trademark Office for review and granting of the commensurate patent rights.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadcast interpretation so as to encompass all such modifications and similar arrangements and procedures.

What is claimed is:

1. A connector between a lamp rod and a lamp base comprising: a lamp base disposed on a side of a wire connection box, and a lamp rod being inserted into the lamp base; wherein:

said wire connection box having a passing hole, and the passing hole is aligned with the lamp base;

said lamp base having a passing section protruding out of the passing hole of the wire connection box, the lamp rod being inserted into the passing section of the lamp base;

a pair of symmetric locking holes separately disposed on both sides of a stairway-like edge of the lamp base, in which a locking hole being coupled to an insertion base and the insertion base receiving the insertion of the connector for the connection; and another locking hole being coupled to a restricting structure by a bolt, and the restricting structure using a bolt to pass through the closed bottom of the latching bracket and the spring disposed at the upper section of the latching bracket to couple the latching bracket and the spring onto the upper locking hole of the lamp base;

said lamp rod having a conical slope, and a cut blocking dent being disposed at a position corresponsive to the restricting structure of the lamp base, such that after the lamp rod being inserted into the passing section of the lamp base, the head of the lamp rod exactly pressing and pushing the latching bracket of the restricting structure and returning the spring to its original position after the insertion of the lamp rod by means of the restoration of the spring to latch the cut blocking dent; after insertion of the lamp rod into the lamp base, a head of the lamp rod is pressed against an insertion base to form an electric connection; such arrangement allows users to insert the lamp rod into the lamp base for use and attains the effect of the do-it-yourself assembling of the lamp, wherein said lamp base further comprises a through hole on the side of the lamp base, and a spring bracket being disposed adjacent to the through hole, and an end of the spring bracket extending into the passing hole; a blocking edge being disposed on the lamp rod at the position corresponsive to the lamp rod and the spring bracket of the lamp rod; the free end of the spring bracket latching on the blocking edge after the insertion of the lamp rod.

2. A connector between lamp rod and lamp base as claimed in claim 1, wherein said cut blocking dent of the lamp rod being latched to an end of the lamp base is a serrate surface, being appropriately hooked onto the restricting structure of the lamp base to prevent the ceiling fan/lamp under the lamp rod from falling down due to insufficient support of the weight of the assembled lamp.

3. A connector between lamp rod and lamp base as claimed in claim 1, wherein said passing section of the wire connection box is a structure with a rectangular hole.

* * * * *